United States Patent [19]

Althaus

[11] Patent Number: 4,916,814

[45] Date of Patent: Apr. 17, 1990

[54] WET-SHAVE RAZOR

[75] Inventor: Wolfgang Althaus, Wuppertal, Fed. Rep. of Germany

[73] Assignee: Wilkinson Sword Gesellschaft Mit Beschränkter Haftung, Fed. Rep. of Germany

[21] Appl. No.: 139,816

[22] Filed: Dec. 30, 1987

[30] Foreign Application Priority Data

Jan. 3, 1987 [EP] European Pat. Off. ..... 87100035.2

[51] Int. Cl.[4] ..... B26B 21/20; B26B 21/24; B26B 21/60

[52] U.S. Cl. ..... 30/40.2; 30/50; 30/57; 30/346.56; 30/346.58

[58] Field of Search ..... 30/40, 40.2, 50, 57, 30/58, 87, 89, 346.58, 346.56, 77, 53

[56] References Cited

U.S. PATENT DOCUMENTS

| | | | |
|---|---|---|---|
| 2,352,813 | 7/1944 | Testi | 30/40 |
| 2,565,062 | 8/1951 | Blanchard | 30/40 X |
| 2,636,263 | 4/1953 | Fennelly | 30/40 |
| 3,412,464 | 11/1968 | Keck | 30/40 |
| 3,420,341 | 3/1969 | Choate | 30/40 |
| 3,505,734 | 4/1970 | Iten | 30/346.58 |
| 3,619,900 | 11/1971 | Matsuura | 30/40 |
| 3,648,365 | 3/1972 | Iten et al. | 30/40 |
| 3,722,091 | 3/1973 | Gagnon | 30/40 |
| 4,034,892 | 7/1977 | Braginetz | 221/64 |
| 4,090,638 | 5/1978 | Pentney | 221/307 |
| 4,094,066 | 6/1978 | Daniel, Jr. | 30/346.58 |

FOREIGN PATENT DOCUMENTS

| | | |
|---|---|---|
| 025117 | 4/1980 | European Pat. Off. . |
| 1204106 | 10/1965 | Fed. Rep. of Germany . |
| 1909989 | 2/1970 | Fed. Rep. of Germany . |
| 1949400 | 8/1970 | Fed. Rep. of Germany . |
| 2496536 | 6/1982 | France . |
| 202023 | 3/1939 | Switzerland . |
| 2066107 | 12/1980 | United Kingdom . |

*Primary Examiner*—Frank T. Yost
*Assistant Examiner*—Rinaldi Rada
*Attorney, Agent, or Firm*—Finnegan, Henderson, Farabow, Garrett & Dunner

[57] ABSTRACT

A wet shave turret razor assembly includes a razor head and single or double blades. The razor head is mounted at the front end of a handle. Several blades are uniformly mounted along the periphery of a blade holder. The blade holder is attached to the razor head by a rotation spindle. The blades are pivotable about an axis. The edges of the blades are parallel to the axis. Further, the blade holder in conjunction with the blades is rotatable by a knob. The knob is located in the axis and mounted on the blade holder for snapping the blades into the shaving position. To improve razor handling, the rotary knob is telescopable. The blade holder is provided with a hood and a thread enclosure.

20 Claims, 2 Drawing Sheets

WET-SHAVE RAZOR

BACKGROUND OF THE INVENTION

The present invention relates to a wet shave razor including a blade holder having a razor head comprising single or double-blades mounted at the front end of a handle several blades are mounted uniformly around the periphery of a common blade holder that is pivotable about an axis. The blade edges are parallel to the axis and the blade holder. The blades are rotatable into a snap-in shaving position by means of a rotary knob that is mounted on the blade holder and located in the axis.

Such a razor with a so-called turret head is known from the German Offenlegungsschrift 19 49 400 and consists of a razor head mounted at the front end of a handle. Wherein, a blade holder is rotatably supported by the razor head between the end faces of housing walls and is equipped with blades distributed along its periphery. The blade edges are parallel to the axis of rotation of the blade holder. The blades may be either single or double blades. To allow rotatable of the blade holder in the blades about its axis of rotation, one of the pivot spindles of the blade holder is extends through the razor head housing to the outside and is provided at the free end with a rotary knob. When a razor blade is worn, the blade holder is rotated until an unused blade comes into the shaving position. To fasten the blade holder in the razor head, a snap-in means is provided, which consists of a spring mounted on the housing of the razor head and snapping into corresponding clearances according to the positions of the blades in the blade holder.

In this conventional razor it is very difficult to actuate the rotary knob that is located tightly against the outer end face of the razor head housing. This is because the user's fingers cannot properly seize the rotary knob. Indeed the rotary knob, and therefore the blade holder, can be grasped and therefore driven only by the finger tips. This is quite difficult on account of the small diameter of the rotary knob. Furthermore, a relatively large force must be applied to snap the blade holder out of one and into another position. Thus, it is difficult to separate the rotary knob. Finally, in conventional razors the blade holder can be rotated into either direction, and the user therefore does not know when changing blades whether he is rotating the blade holder in the right direction. If he rotates in the wrong direction, he will be dispensed not a new, but an already used blade. Another drawback is that the user, even when rotating the blade holder in the proper direction, will not know all the blades have been used due to the completion of the blade rotational cycle. Accordingly, it is possible for the user to start the rotational cycle again and undesirably employ a used blade.

Still another drawback of the conventional razor is that it is very difficult to exchange a used blade holder for a new blade holder. In the conventional razor, the end face housing side walls of the razor head must be disassembled from the housing to free the blade holder and to allow it to be exchanged for a new one. This is especially difficult because of the small dimensions of the razor head and the side walls. Much dexterity is required. Moreover, the blade holder must be seized when being exchanged, and accordingly there is high danger of injury. Also, the blade holder is unprotected when the razor is left unused, whereby the blade edges are exposed thereby increasing the chance of injury. Severe cuts from instance can be inflicted upon unintentional contact with the razor head.

SUMMARY OF THE INVENTION

An object of the present invention is a wet shave razor having multiple blades pivotably stored for the selective usage of subsequent blades that is simply designed and easily rotatable.

A further object of the present invention is a wet shave razor which has improved shaving qualities and which minimizes the probability of accidental injury of the user by the razor blades.

When the rotary knob is in the extended position, it is easily gripped by the user's fingers because a greater surface area of the user's fingers can engage the knob than when the knob is in the retracted position, proximate to the blade holder. In contrast, when the knob is in the retracted position, the knob and the blade holder are compactly arranged so as not to hamper the shaving process.

To achieve the objects and in accordance with the purpose of the present invention, there is provided a razor assembly comprising a handle, a blade holder rotatably mounted on the handle for rotation about an axis, a plurality of blades mounted around the periphery of the blade holder and having edges generally parallal to the axis, and actuator means mounted on the blade holder movable in a direction generally parallel to the axis between a first position proximate to the blade holder for shaving and a second position extended from the blade holder for facilitating rotation of the blade holder relative to the handle.

Preferably the rotary knob is mounted on the free end of an actuation rod displaceably supported in a throughbore in the axis of the blade holder, the other end of this actuation rod being provided with a stop 14 which does not rotate relative to the blade holder. The rotary knob is easily pulled out and when turned will transmit all of the torque to the blade holder to rotate the blade holder.

The invention further proposes that the blade holder be rotatable only in one direction.

This entails the advantage of eliminating the risk of an already used blade again arriving in the shaving position due to faulty rotation. Due to the unidirectional rotation, the unused blade holders are sequentially rotated into the shaving position. The first blade might be marked, so that the user seeing the marking again shall know all blades have been used up and that this blade holder must be exchanged for a new one. Such a marking illustratively may be by means of color.

To prevent repeat passage of the razor blades, provision furthermore may be made for a stop preventing further rotation when the last blade has been reached upon full revolution. Thereby the user is automatically told that the last blade just has been used, because rotation no longer is possible.

The invention proposes further that the razor head be mounted only at one end and that it include at the other a freely extending rotation spindle onto which the blade holder can be plugged.

Thereby it is a very simple matter to exchange a used blade holder for a new one. The used blade holder merely requires being pulled off the rotation spindle, with the new one being plugged onto it. This can be carried out in minimal time.

In a further preferred embodiment of the invention, the rotation spindle comprises a spring projecting beyond the peripheral surface and the spring enters a peripheral clearance inside the blade holder. The peripheral clearance has an essentially inner polygonal cross-section to match the arrangement of the blades on the blade holder. due to the cooperation of the spring with the polygonal inner cross-section of the blade holder a snap-in means is created in very simple manner, and fastens the blades into the snap-in position in problem-free manner. Moreover, because the spring enters the peripheral clearance inside the blade holder, this blade holder is axially fixed on the rotation spindle. Nevertheless, once the spring opposition has been overcome, it is then a very simple step to pull the blade holder off the rotation spindle and to plug in a new, unused blade holder.

In a preferred further development, the razor head or the blade holder is pivotable relative to a fixed zero position about the rotation spindle of the razor head. Thereby a pivot head effect is achieved, improving the shaving qualities and also the handling of the razor.

Moreover the present invention includes a hood which can be plugged on the blade holder in its longitudinal direction and protects the blades against accidental contact.

Preferably the hood includes a detent beak which can snap by finger pressure into a corresponding recess in the blade holder. This step offers the advantage on one hand to cover the blade holder and on the other to remove in simple manner a blade holder with used blades by means of the hood from the razor head without having to directly touch the blade holder. The blade holder is exchanged merely by plugging the hood on it and by snapping the detent beak of the hood into the corresponding recess in the blade holder by finger pressure. In that state, the blade holder is fastened within the hood by means of which it can be removed from the razor head. New and unused blade holders can be stored in this manner in the hoods. To replace the blade holder, it is merely necessary to plug the hood with the blade holders onto the rotation spindle, and to remove the hood after releasing the detent beak, whereby the new blade holder shall already be in its final position in the razor head.

The present invention further employs threads wound around the blade holder and the blades.

The thread enclosure assures excellent protection against injury when the edge is accidentally touched or if during shaving the user slips, which, without the thread enclosure would lead to a cut. In spite of this thread enclosure, the shaving properties of the blades are practically undegraded. Again the wire improves the fastening of the razor head parts, thereby increasing their assembled accuracy and providing more uniform shaving.

Preferably the thread is metallic and of copper, silver or stainless steel. Instead of a metal wire, a plastic fiber filament also may be used, in particular consisting of polyamides, polystyrene, polyethylene vinylidene-vinylchloride copolymer, acrylonitrile copolymers, polyurethanes of rubbery elasticity or polyterephthalic-acid esters.

In a further preferred embodiment the thread may be coated with a friction lowering means acting as a lubricant. This coating in particular may consist of a water soluble polymer, especially polyethylene oxide, polyvinyl pyrrolidone, methyl cellulose or polyvinylmethylene ester. Instead of the water soluble polymer, the coating also may consist of a material which is hygroscopic but not water-soluble, illustratively polyvinyl alcohol fibers or a polyurethane-polyvinyl interpolymer. When using such lubricants to reduce the friction of the threads, these threads shall slide unhampered over the user's skin and thereby will not degrade the shaving process. When a water-soluble polymer is used as the lubricant, its adhesion and cohesion must be so adjusted that water and pressure must be combined to achieve detachment. The water serves to release the water soluble polymer while the pressure assures the required abrasion and thereby achieves lubrication.

Preferably the diameter of the thread is less than 0.1 mm.

To reliably keep the thread in position, a further feature of the invention provides clearances in the blade holder or in the blades to receive the thread. By guiding the thread in the clearances, lateral displacement is prevented. Furthermore, the thread may also be bonded to the blade holder.

The invention also proposes generally using this thread enclosure for razor blades. This thread enclosure is not restricted to the so called turret head razors, but can be applied to any razor, that is, also to the so-called disposable razors where the blade is solidly imbedded in the blade holder, and to the re-usable razors, where the used blades are exchanged for new ones. The advantages described above apply equally to all these razors.

The invention provides further to equip the blade holder with narrow blades. Such narrow blades are wider than 2 mm and are the necessary condition for a turret-head size allowing housing four shaving units without thereby hampering shaving in awkward spots by the dimensions of the razor head.

Because the unused blades are expressed nevertheless to water and shaving accessories in operation, the blade quality must be such that its shaving grade shall be preserved. This is achieved in another feature of the invention by making the blade of a non-oxidizing material, in particular of stainless steel. In addition, the blades also may be hardened. Preferably the blade edges are coated with a high-grade metal, in particular chromium, and/or plastic, in particular PTFE. Lastly the present invention surface treats the free metal surfaces of the blades to reduce the adhesion of the shaving accessories and beard residues.

The present invention provides a blade dispenser for a razor of the above described kind, comprising compartments each holding one blade holder. The blade holders located in the compartments can be removed by the razor head only in a single position. This assures that when a blade holder as yet unused is removed from the dispenser, the right position shall be set without having to first rotate the blade holder into the proper position. It is furthermore possible to move the operational blade holder into the temporary protected position in the corresponding compartment in the dispenser without there being a danger that upon withdrawing it again it might be placed in another position.

In a preferred embodiment of the dispenser, the compartment assume the shape of ducts with an end aperture from which the blade holders can be retrieved along their axes. At least one offset flange is located around the compartment apertures which prevents the razor head from being slipped on in the wrong manner. The flange prevents the razor head from being slipped on in the wrong position and the blade holder being removed from its compartment. That is, one side of the duct aperture is free of a flange and it is that particular side which may be slipped on the razor head.

It is possible instead, or also in addition, that the razor head form an angle relative to the razor handle for the purpose of extracting the blade holders out of the dispenser compartments. By means of the razor head angle and a suitable geometry of the compartments, the razor head can be slipped on only in a very specific position. In any other position the razor abutts into adjacent compartments thereby preventing the entry onto the blade holder.

Lastly one side wall of each of the dispenser compartments is formed of an elastic strip. This assures that the blade units can be easily removed from the compartments.

Various technical solutions have been described above with reference to the present invention which improve the handling of the so called turret razors. Each technical solution is usable above or may be employed in combination with one another.

BRIEF DESCRIPTION OF THE DRAWINGS

The accompanying drawings, which are incorporated in and constitute a part of this specification, illustrate several embodiments of the present invention and together with the description, serve to explain the principles of the present invention.

FIG. 8 is a top view of the dispenser of FIG. 7 after the razor head has been slipped on.

DETAILED DESCRIPTION OF THE PREFERRED EMBODIMENTS

Figure 1:
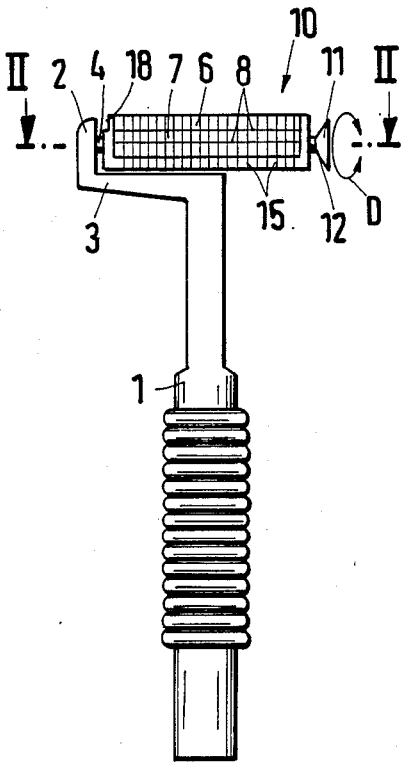
FIG. 1 is an elevation of the razor according to the teachings of the present invention.

The turret razor shown in FIG. 1 consists of a handle 1 and a razor head 2 mounted at the front end of the handle 1.

A rotation spindle 4 is mounted transversely to the lengthwise direction of the handle 1 at an L-shaped extension 3 of this handle. The rotation spindle 4 is a cantilever, as shown in particular by FIG. 2. The handle 1, the extension 3 and the rotation spindle 4 may be integral and may consist of plastic or metal. A spring 5 is mounted in the rotations spindle 4 and projects from the periphery of the rotation spindle 4 through a slot to the outside. This is shown more clearly in FIG. 2. This spring 5 can be compressed into the inside of the rotation spindle 4 transversely to its lengthwise direction.

A blade holder 6 is slipped onto the rotation spindle 4 (from the right in the drawing). This blade holder 6 has a substantially square cross-section. A razor blade 7 in the form of a double blade is firmly fused on each side. The edges 8 of the blades 7 are parallel to the central rotation spindle 4.

The rotation spindle 4 defines an axis A about which the blade holder 6 may pivot together with the blades 7, as indicated by the arrow D.

Figure 2:
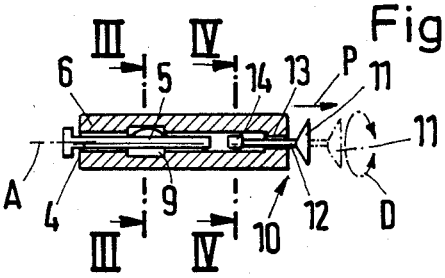
FIG. 2 is a section along line II—II of FIG. 1 through the razor head.
Figure 3:
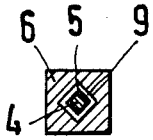
FIG. 3 is a section along line III—III of FIG. 2 in the area of the blade-holder detent.
Figure 4:
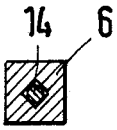
FIG. 4 is a section along line IV—IV of FIG. 2 in the area of the blade-holder rotation means.

To fasten the blade holder 6 on the rotation spindle 4 properly in the axial direction of the spindle 4 and the rotational position, the blade holder is provided at its inside with a peripheral recess 9 of square cross-section as indicated in FIG. 2. This peripheral recess 9 abuts at its end the spring 5 of the rotation spindle 4. As a result, positioning the axial of the blade holder 6 is determined. When the force of the spring 5 is overcome, the spring is depressed into the rotation spindle 4 and thereby it is then possible to pull the blade holder 6 off the rotation spindle 4. Correspondingly, a new blade holder 6 can be fixed in its position after it has been slipped onto the rotation spindle 4.

Because of the square cross-section of the peripheral recess 9, the spring 5 always comes to rest in the corners. Thus an angular position of the blade holder 6 relative to the rotation spindle 4 is achieved. This snap-in positioning defines the shaving position of the blade holder 6 and hence of the blades 7.

A rotation means 10 is provided to pivot the blade holder 6 on the rotation spindle 4. This rotation means 10 consists of a rotary knob 11 outside the blade holder 6. This rotary knob 11 is located along in the axis A of the spindle 4. The rotary knob 11 is provided with an actuation rod 12 axially displaceably passing through a bore 13 at the end face of the blade holder 6. The end of the actuation rod 12 located inside the blade holder 6 comprises a stop 14 of non-circular cross-section. In, in the example shown the stop has a cross sectional shape, square. The inside contour of the blade holder 6 matches the cross section of the stop. Thus, the stop 14 may not rotate inside the blade holder 6.

In the rest position, the rotary knob 11 is in the plugged-in or position (solid line in FIG. 2). To rotate the blade holder 6 to the next position, the rotary knob 11 is pulled out or extended, as indicated by the arrow P, to the telescoped position shown in FIG. 2 in dashed lines. Due to the irrotational mounting of the stop 14 inside the blade holder 6, rotating the rotary knob 11 will also rotate the blade holder 6 into the next position of the blade 7. At the end of the rotation, the rotary knob 11 is pushed-in again (from right to left in the drawing).

FIG. 1 shows the blade holder 6 spirally enveloped by a thread 15 preferably of a diameter less than 0.1 mm. This thread enclosure acts to minimize injury while preserving the shaving properties of the blades 7.

Figure 6:
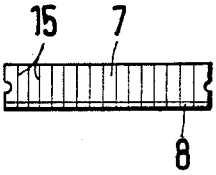
FIG. 6 is a perspective of a razor blade enclosed by a thread.

The use of this thread enclosure is not restricted to the blade holders 6 of such turret razors. The thread enclosure or winding may be used or any kind of razor blades 7. FIG. 6 shows in purely illustrative manner a single blade 7 provided with such a thread enclosure. To fasten the thread 15 in place, the blade 7 (or the blade holder 6) may be provided with recesses through which passes the thread 15 which is thereby protected against displacement. Additionallly, the thread 15 may bonded, soldered or fused to the blade 7. Such a blade 7 thereupon can either be imbedded in a razor blade unit the way it is done with disposable type razors, or the blade 7 may be exchangeable as a single component in a corresponding razing head.

Figure 5:
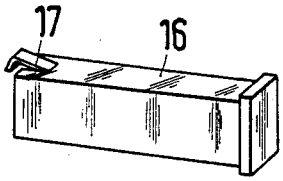
FIG. 5 is a perspective of a hood for the blade holder shown in FIG. 1.

As shown in FIG. 5, a hood 16 may be slipped as a protection means on the blade holder 6 of the razor head 2. Hood 16 has a cross sectional shape similar to that of the blade holder 6 and is tubular. Further, one end of the hood 16 is closed and the other end is open. In the embodiment shown in FIG. 5, the hood 16 comprises a detent beak 17 which when manually depressed snaps into a clearance 18 in the blade holder 6. As a result, when pulling out the hood 16, a blade holder 6 with used blades 7 can be removed from the rotation spindle 4 without having to touch the blade holder 6. Further, the blade holder 6 together with its blades 7 may be firmly mounted in the hood 16. Moreover, new and unused blade holders 6 can be stored in corresponding hoods 16 and be slipped in this manner on the rotation spindle 4 of the razor head 2. By not pressing on the detent beak 17, the hood 16 can be pulled off the blade holder 6 leaving the blade holder in position on the rotation spindle 4.

Figure 7:
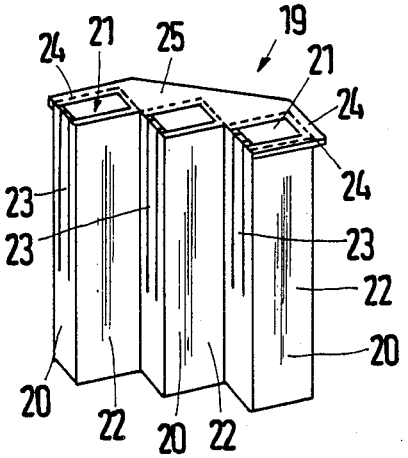
FIG. 7 is a perspective of a dispenser from which the razor removes the blades.

FIG. 7 shows a dispenser 19 housing individual blade holders 6. This dispenser 19 consists of ducts 20 having a square cross section. The ducts are open only a a sectional shape which. The ducts at one end defining apertures 21. One sidewall of the ducts 20 is designed to be an elastic strip 23.

As shown in the embodiment, the ducts 20 of the dispenser 19 are joined to each other by their longitudinal edges and form a zig-zag external contour. As shown in particular by FIG. 8, the two outer ducts are provided with flanges 24 around the duct apertures 21. Only the sidewall 22 is recessed with the spring strip 23. The rear sides of the ducts 20 are provided with a reinforcing component 25 to strengthen the dispenser 19.

Figure 8:
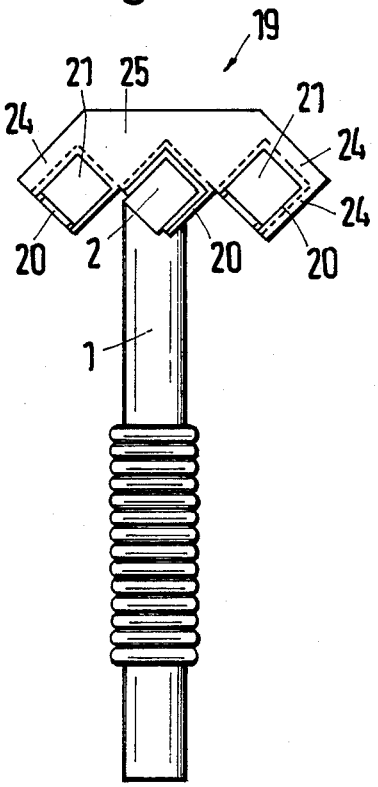

Such a dispenser 19 can be placed on the razor head to effect transfer of the blade holder 2 only in a very specific position and from one side only. This placement is carried out in two steps. If the razor head 2 attempts to enter the dispenser 19 in the wrong position, the adjoining ducts 22 being in the way prevent successful placement as shown in FIG. 8, if the razor head 2 were to be placed in the dispenser 19 at a 90° in the counterclockwise direction, the handle 1 would hit the end face of the right hand duct 20 of the dispenser 19. This also would be the case if the razor head 2 were rotated clockwise by 90°. Further, the present flanges 24 aids in achieving the proper placement. That is, the spacing between the rotation spindle 4 of the razor head 2 and the extension 3 at the handle 1 is not sufficient to allow the razor head 2 to properly receive the blade holder 6. In this latter case the front end of the handle 1, or the extension 3 of the handle 1, would hit the flange 24 or the reinforcing component 25 and thereby satisfactory placement of the blade holder on the razor head 2.

In the embodiment depicted, the ducts 20 of the dispenser 19 are mounted edge against edge to form a zig-zag outer contour. However other arrangements of the ducts 20 are also possible provided that the razor head 2 can enter the dispenser 19 and receive the blade holders 6 only from one side of the dispenser.

Other embodiments of the present invention will be apparent to those skilled in the art from consideration of the specification and practice of the disclosed invention. It is intended that the specification and examples be considered as exemplary only, with the true scope and spirit of the invention being represented by the following claims and their equivalents.

What is claimed is:

1. A razor assembly comprising:

a handle;

a blade holder rotatably mounted on said handle for rotation about an axis;

a plurality of blades mounted around the periphery of said blade holder and having edges generally parallel to said axis; and actuator means mounted on said blade holder for rotating said blade holder relative to said handle, said actuator means including a portion having a shape which is grippable and movable by the user's fingers in a substantially unrestricted manner in a direction generally parallel to said axis between a first position proximate to said blade holder for shaving and a second position extended from but engaged with said blade holder for facilitating rotation of said actuator means and said blade holder relative to said handle by rotation of the actuator means with the user's fingers.

2. The razor assembly of claim 1 wherein the blade holder includes a bore and the handle includes a cantilevered spindle receivable in the bore for rotationally supporting said blade holder.

3. The razor assembly of claim 2 further comprising a dispenser for receiving said blade holders, said dispenser having a plurality of housing ducts for receiving said blade holders, said blade holders being retrievable upon positioning the razor head only in one specific direction relative to each of said ducts.

4. The razor assembly of claim 3, wherein said ducts are socket-like and include an aperture at one end for receiving said blade holders along said axis and including at least one offset flange around said duct aperture to prevent insertion of the razor head in a direction other than said specific direction.

5. The razor assembly of claim 4 wherein said ducts include a sidewall forming an elastic strip.

6. The razor assembly of claim 2, wherein said bore has a polygonal cross section forming recesses in the bore, and further including spring means projecting from said rotation spindle for engaging the recesses in said bore, orienting said blade holder relative to said rotation spindle, and resisting rotational movement of said blade holder relative to said rotation spindle.

7. The razor assembly of claim 1 including a hood having an axially extending chamber for receiving said blade holder and including means manually engageable with said blade holder for selectively restraining said blade holder for removing and attaching said blade holder from said handle.

8. The razor assembly of claim 7, wherein said manually engagable means comprises a detent-beak operable by finger pressure into engagement with a corresponding clearance located in said blade holder.

9. The razor assembly of claim 1 wherein said actuator means includes an actuation rod with a knob on one end, and said blade holder includes a bore extending parallel to said axis for slidably receiving the other end of said actuation rod, said other end of said actuation rod including stop means for preventing rotation of the actuator rod relative to the blade holder.

10. The razor assembly of claim 1 wherein said knob means includes an actuation rod with a knob on one end, said knob having a conically shaped surface which diverges from said blade holder.

11. The razor assembly of claim 1 further comprising a thread covering a portion of the blade holder and blades for protecting the user against injuries from the blades while shaving.

12. The razor assembly of claim 10 wherein said thread is formed of a metal wire consisting of one of copper, silver or stainless steel.

13. The razor assembly of claim 10, wherein said thread is formed of a plastic fiber consisting of one of polyamide, polyethylene, polystyrene, vinylidene-vinyl-chloride copolymer, acrylonitrile copolymer, rubber-elastic polyurethane and polyterephthalic-acid ester.

14. The razor assembly of claim 10 wherein said thread has a diameter of less than 0.1 mm.

15. The razor assembly of claim 10 wherein at least one of said blade holder and said blades includes clearances for receiving of said thread.

16. The razor assembly of claim 10 wherein said blades are formed of a corrosion-free material comprising stainless steel.

17. The razor assembly of claim 10 wherein said blades are hardened.

18. The razor assembly of claim 10 wherein the edges of the blades are coated with a high-grade metal, consisting of chromium with PTFE.

19. The razor assembly of claim 11 wherein said thread has a friction reducing lubricating coating made of a water-soluble polymer consisting of one of polyethylene oxide, polyvinyl pyrrolidone, methyl cellulose and polyvinyl methylene-ether.

20. The razor assembly of claim 11 wherein said thread has a friction reducing lubricating coating made of a hygroscopic water-insoluble material consisting of one of polyvinyl alcohol fibers and polyurethane-polyvinyl interpolymer.

* * * * *